US011395086B2

(12) United States Patent
Hall et al.

(10) Patent No.: US 11,395,086 B2
(45) Date of Patent: Jul. 19, 2022

(54) LISTENING OPTIMIZATION FOR CROSS-TALK CANCELLED AUDIO

(71) Applicant: Jawbone Innovations, LLC, Marshall, TX (US)

(72) Inventors: James Hall, Sunnyvale, CA (US); Thomas Alan Donaldson, Nailsworth (GB)

( * ) Notice: Subject to any disclaimer, the term of this patent is extended or adjusted under 35 U.S.C. 154(b) by 0 days.

(21) Appl. No.: 14/209,959

(22) Filed: Mar. 13, 2014

(65) Prior Publication Data

US 2015/0264503 A1 Sep. 17, 2015

Related U.S. Application Data

(60) Provisional application No. 61/786,445, filed on Mar. 15, 2013.

(51) Int. Cl.

| | |
|---|---|
| ***H04S 7/00*** | (2006.01) |
| ***H04R 3/00*** | (2006.01) |
| ***H04R 5/04*** | (2006.01) |

(52) U.S. Cl.

CPC ..... *H04S 7/30* (2013.01); *H04R 3/002* (2013.01); *H04R 5/04* (2013.01); *H04S 7/303* (2013.01); *H04S 2420/01* (2013.01)

(58) Field of Classification Search

CPC ..... H04S 2420/01; H04S 7/30; H04S 5/00; H04S 7/303; H04S 2400/01; H04S 3/008; H04S 7/302

USPC ..... 381/303

See application file for complete search history.

(56) References Cited

U.S. PATENT DOCUMENTS 8,320,592 B2 * 11/2012 Kim ..... H04S 1/00 381/17

8,494,189 B2 * 7/2013 Katayama ..... H04S 7/302 381/1

8,929,572 B2 * 1/2015 Kim ..... H04S 1/002 381/1

* cited by examiner

*Primary Examiner* — Mark Blouin

(57) ABSTRACT

Various embodiments relate generally to electrical and electronic hardware, computer software, wired and wireless network communications, and audio and speaker systems. More specifically, disclosed are an apparatus and a method for processing signals for optimizing audio, such as 3D audio, by adjusting the filtering for cross-talk cancellation based on listener position and/or orientation. In one embodiment, an apparatus is configured to include a plurality of transducers, a memory, and a processor configured to execute instructions to determine a physical characteristic of a listener relative to the origination of the multiple channels of audio, to cancel crosstalk in a spatial region coincident with the listener at a first location, to detect a change in the physical characteristic of the listener, and to adjust the cancellation of crosstalk responsive to detecting the change in the physical characteristic to establish another spatial region at a second location.

18 Claims, 4 Drawing Sheets

LISTENING OPTIMIZATION FOR CROSS-TALK CANCELLED AUDIO

CROSS-REFERENCE TO RELATED APPLICATIONS

This application is a U.S. non-provisional patent application that claims the benefit of U.S. Provisional Patent Application No. 61/786,445, filed Mar. 15, 2013, and entitled "LISTENING OPTIMIZATION FOR CROSS-TALK CANCELLED AUDIO," which is herein incorporated by reference for all purposes.

FIELD

Various embodiments relate generally to electrical and electronic hardware, computer software, wired and wireless network communications, and audio and speaker systems. More specifically, disclosed are an apparatus and a method for processing signals for optimizing audio, such as 3D audio, by adjusting the filtering for cross-talk cancellation based on listener position and/or orientation.

BACKGROUND

Listeners that consume conventional stereo audio typically experience the unpleasant phenomena of "crosstalk," which occurs when sound for one channel is received by both ears of the listener. In the generation of three-dimensional ("3D") audio, crosstalk further destroys the sounds that the listener receives. Thus, minimizing crosstalk in 3D audio has been more challenging to resolve. One approach to resolving crosstalk for 3D sound is the use of a filter that provides for crosstalk cancellation. One such filter is a BACCH® Filter of Princeton University.

While functional, conventional filters to cancel crosstalk in audio are not well-suited to address issues that arise in the practical application of such crosstalk cancellation. A typical crosstalk cancellation filter, especially those designed for a dipole speaker, provide for a relatively narrow angular listening "sweet spot," outside of which the effectiveness of the crosstalk cancellation filter decreases. Outside of this "sweet spot," a listener can perceive a reduction in the spatial dimension of the audio. Further, head rotations can reduce the level crosstalk cancellation achieved at the ears of the listener. Moreover, due to room reflections and ambient noise, crosstalk cancellation techniques achieved at the ears of the listener may not be sufficient to provide a full 360° range of spatial effects that can be provided by a dipole speaker.

Thus, what is needed is a solution without the limitations of conventional techniques.

BRIEF DESCRIPTION OF THE DRAWINGS

Various embodiments or examples ("examples") of the invention are disclosed in the following detailed description and the accompanying drawings.

DETAILED DESCRIPTION

Various embodiments or examples may be implemented in numerous ways, including as a system, a process, an apparatus, a user interface, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided below along with accompanying figures. The detailed description is provided in connection with such examples, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

Figure 1:
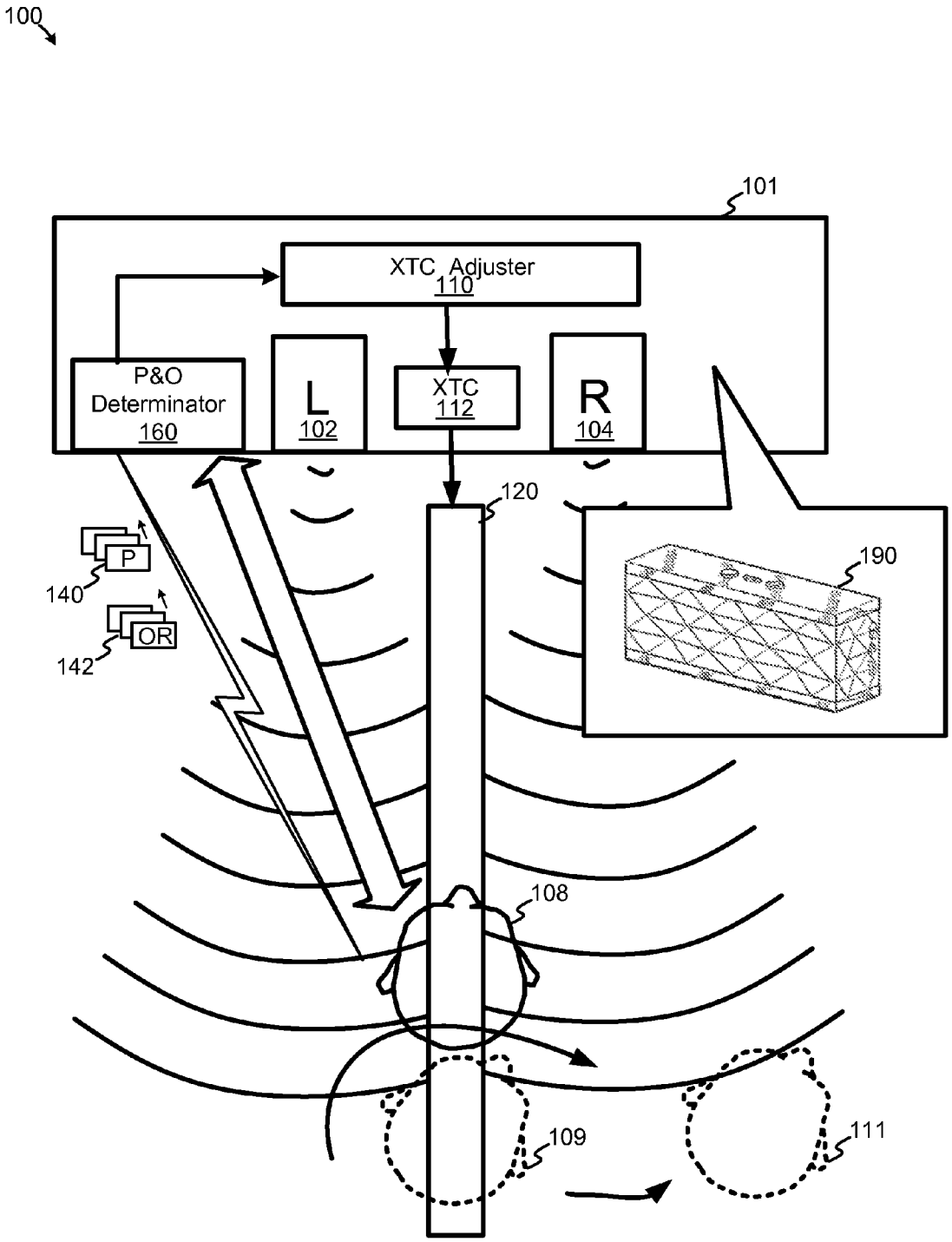
FIG. 1 illustrates an example of a crosstalk adjuster, according to some embodiments.

FIG. 1 illustrates an example of a crosstalk adjuster, according to some embodiments. Diagram 100 depicts an audio device 101 that includes one or more transducers configured to provide a first channel ("L") 102 of audio and one or more transducers configured to provide a second channel ("R") 104 of audio. In some embodiments, audio device 101 can be configured as a dipole speaker that includes, for example, two to four transducers to carry two (2) audio channels, such as the left channel and a right channel. In implementations with four transducers, a channel may be split into frequency bands and reproduced with separate transducers. In at least one example, audio device 101 can be implemented based on a Big Jambox 190, which is manufactured by Jawbone®, Inc.

As shown, audio device 101 further includes a crosstalk filter ("XTC") 112, a crosstalk adjuster ("XTC adjuster") 110, and a position and orientation ("P&O") determinator 160. Crosstalk filter 112 is configured to generate filter 120 which is configured to isolate the right ear of listener 108 from audio originating from channel 102 and further configured to isolate the left ear of listener 108 from audio originating from channel 104. But in certain cases, listener 108 invariably will move its head, such as depicted in FIG. 1 as listener 109. P&O determinator 160 is configured to detect a change in the orientation of the ears of listener 109 so that crosstalk adjuster 110 can compensate for such an orientation change by providing updated filter parameters to crosstalk filter 112. In response, crosstalk filter 112 is configured to change a spatial location at which the crosstalk is effectively canceled to another spatial location to ensure listener 109 remains with in a space of effective crosstalk cancellation. P&O determinator 160 is also configured to detect a change in position of the ears of listener 111. In response to the change in position, as detected by P&O determinator 160, crosstalk adjuster 110 is configured to generate filter parameters to compensate for the change in position, and is further configured to provide those parameters to crosstalk filter 112.

According to some embodiments, you know determinator 160 is configured to receive position data 140 and orientation 142 from one or more devices associated listener 108. Or, in other examples, P&O determinator 160 is configured to internally determine at least a portion of position data 140 and at least a portion of orientation data 142.

Figure 2:
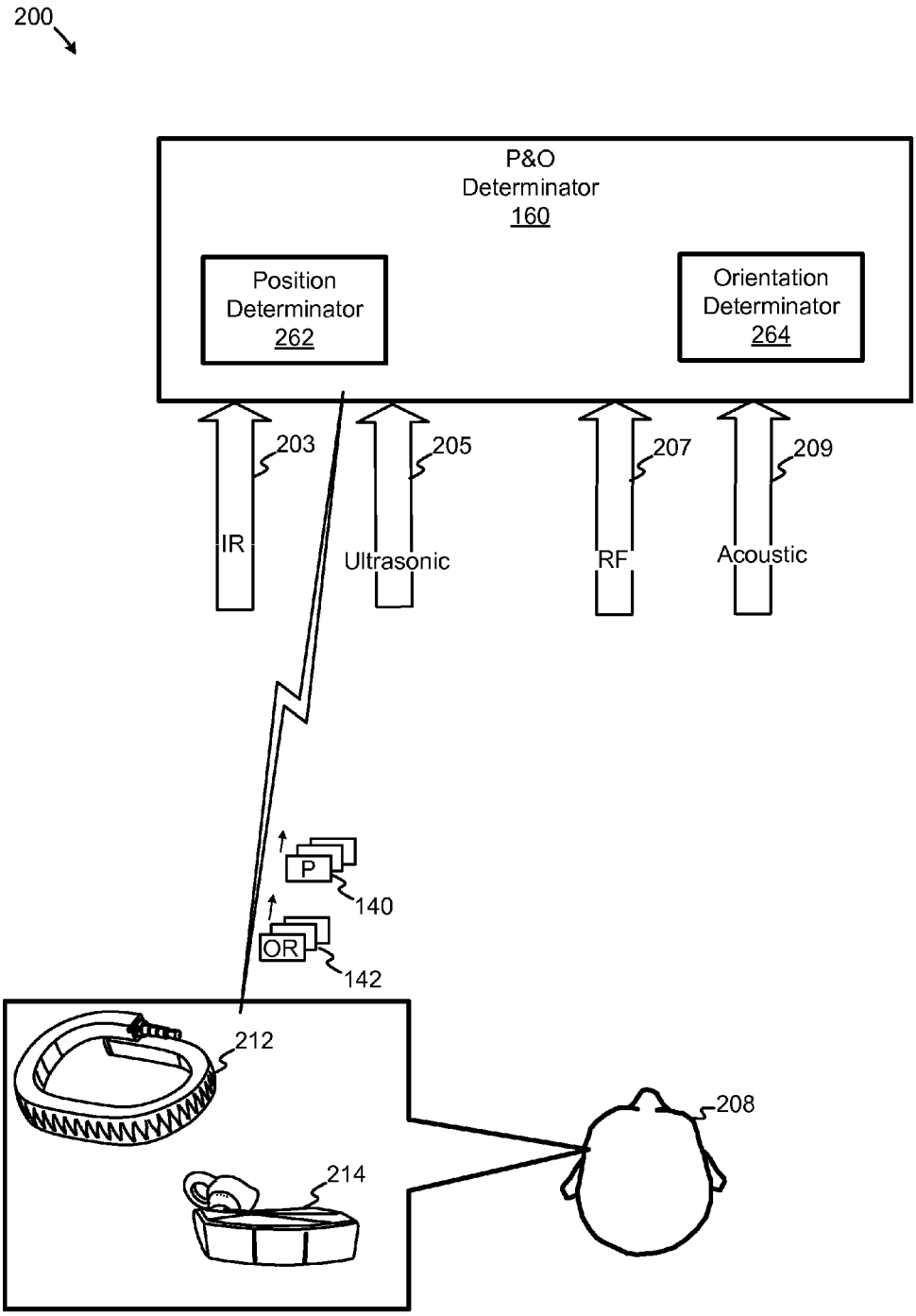
FIG. 2 is a diagram depicting an example of a position and orientation determinator, according to some embodiments.

FIG. 2 is a diagram depicting an example of P&O determinator 160, according to some embodiments. Diagram 200 depicts P&O determinator 160 including a position determinator 262 and an orientation determinator 264, according to at least some embodiments. Position determinator 262 is configured to determine the position of listener 208 in a variety of ways. The first example, position determinator 262 can detect an approximate position of listener 208 using optical and/or infrared imaging and related infrared signals 203. In a second example, position determinator 262 can detect of an approximate position of listener 208 using ultrasonic energy 205 to scan for occupants in a room, as well as approximate locations thereof. In a third example, position determinator 262 can use radio frequency ("RF") signals 207 emanating from devices that emit one or more RF frequencies, when in use or when idle (e.g., in ping mode with, for example, a cell tower). In the fourth example, position determinator 262 can be configured to determine approximate location of listener 208 using acoustic energy 209. Alternatively, position determinator 262 can receive position data 140 from wearable devices such as, a wearable data-capable band 212 or a headset 214, both of which can communicate via a wireless communications path, such as a Bluetooth® communications link.

According to some embodiments, orientation determinator 264 can determine the orientation of, for example, the head and the ears of listener 208. Orientation determinator 264 can also determine the orientation of user 208 by using for example MEMS-based gyroscopes or magnetometers disposed, for example, in wearable devices 212 or 214. In some cases, video tracking techniques and image recognition may be used to determine the orientation of user 208.

Figure 3:
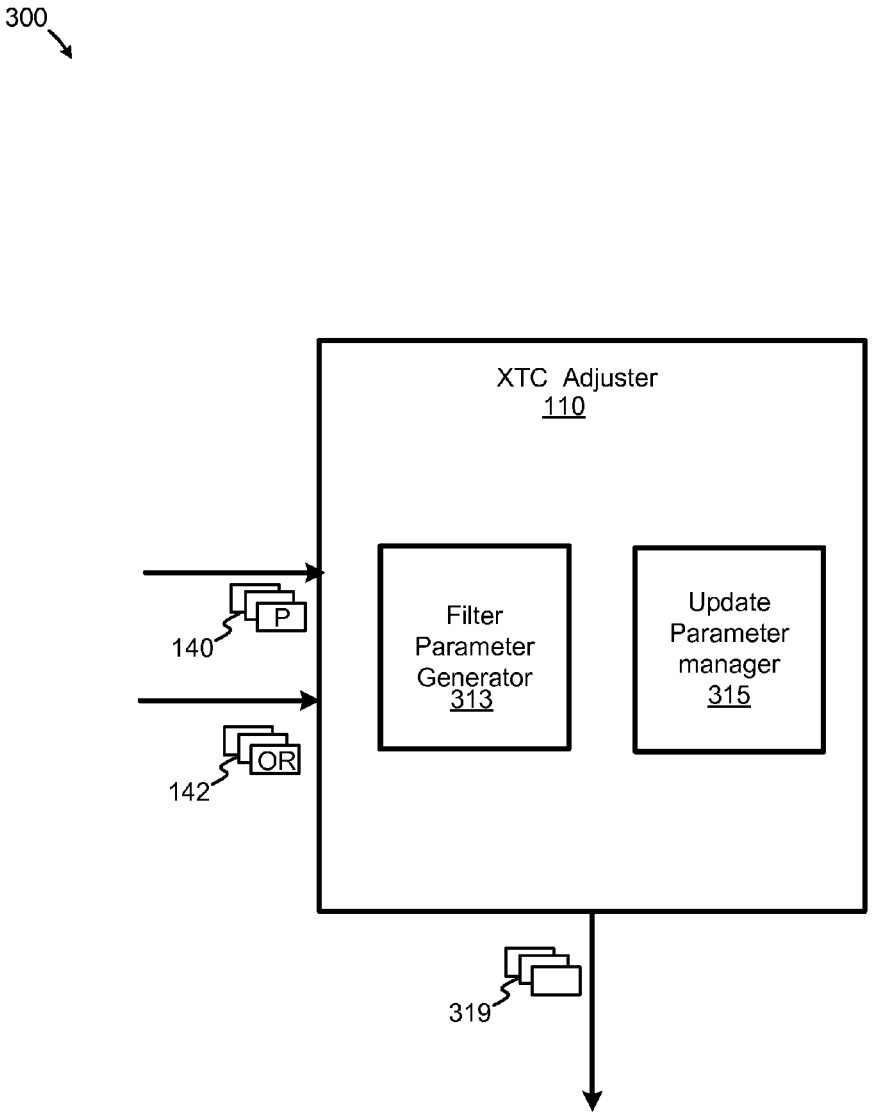
FIG. 3 is a diagram depicting a crosstalk cancellation filter adjuster, according to some embodiments.

FIG. 3 is a diagram depicting a crosstalk cancellation filter adjuster, according to some embodiments. Diagram 300 depicts a crosstalk cancellation filter adjuster 110 including a filter parameter generator 313 and an update parameter manager 315. Crosstalk cancellation filter adjuster 110 is configured to receive position data 140 and orientation data 142. Filter parameter generator 313 uses position data 140 and orientation data 142 to calculate an appropriate angle, distance and/or orientation with which to use as control data 319 to control the operation of crosstalk filter 112 of FIG. 1 Update parameter manager 315 is configured to dynamically monitor the position of the listener at a sufficient frame rate, such as at (e.g., 30 fps) if using video, and correspondingly activate filter parameter generator 313 to generate update data configure to change operation of the crosstalk filter as an update.

Figure 4:
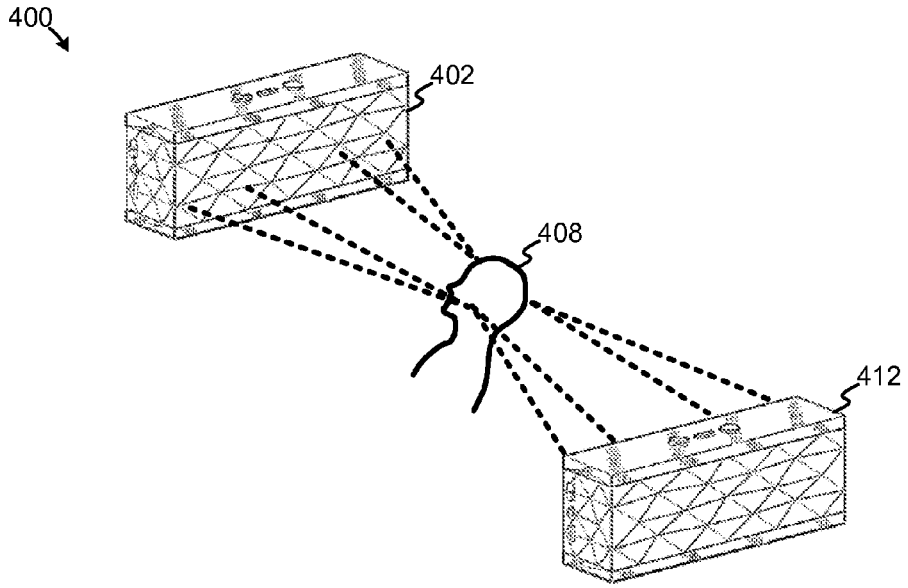
FIG. 4 depicts an implementation of multiple audio devices, according to some examples.

FIG. 4 depicts an implementation of multiple audio devices, according to some examples. Diagram 400 depicts a first audio device 402 and a second audio device 412 being configured to enhance the accuracy of 3D spatial perception of sound in the rear 180 degrees. Each of first audio device 402 and a second audio device 412 is configured to track the listener 408 independently. Greater rear externalization of spatial sound can be achieved by disposing audio device 412 behind listener 408 when audio device 402 is substantially in front of listener 408. In some cases, first audio device 402 and a second audio device 412 are configured to communicate such that only one of the first audio device 402 and a second audio device 412 need determine the position and/or orientation of listener 408.

Figure 5:
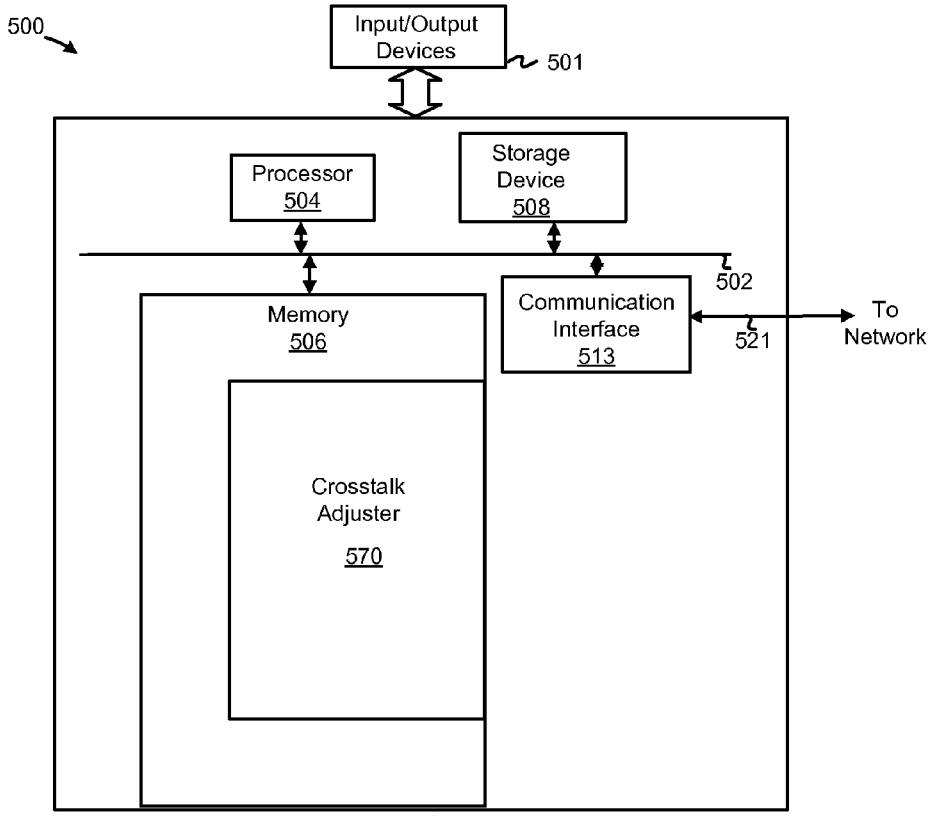
FIG. 5 illustrates an exemplary computing platform disposed in a configured to provide adjustment of a crosstalk cancellation filter in accordance with various embodiments.

FIG. 5 illustrates an exemplary computing platform disposed in a configured to provide adjustment of a crosstalk cancellation filter in accordance with various embodiments. In some examples, computing platform 500 may be used to implement computer programs, applications, methods, processes, algorithms, or other software to perform the above-described techniques.

In some cases, computing platform can be disposed in an ear-related device/implement, a mobile computing device, or any other device.

Computing platform 500 includes a bus 502 or other communication mechanism for communicating information, which interconnects subsystems and devices, such as processor 504, system memory 506 (e.g., RAM, etc.), storage device 505 (e.g., ROM, etc.), a communication interface 513 (e.g., an Ethernet or wireless controller, a Bluetooth controller, etc.) to facilitate communications via a port on communication link 521 to communicate, for example, with a computing device, including mobile computing and/or communication devices with processors. Processor 504 can be implemented with one or more central processing units ("CPUs"), such as those manufactured by Intel® Corporation, or one or more virtual processors, as well as any combination of CPUs and virtual processors. Computing platform 500 exchanges data representing inputs and outputs via input-and-output devices 501, including, but not limited to, keyboards, mice, audio inputs (e.g., speech-to-text devices), user interfaces, displays, monitors, cursors, touch-sensitive displays, LCD or LED displays, and other I/O-related devices.

According to some examples, computing platform 500 performs specific operations by processor 504 executing one or more sequences of one or more instructions stored in system memory 506, and computing platform 500 can be implemented in a client-server arrangement, peer-to-peer arrangement, or as any mobile computing device, including smart phones and the like. Such instructions or data may be read into system memory 506 from another computer readable medium, such as storage device 508. In some examples, hard-wired circuitry may be used in place of or in combination with software instructions for implementation. Instructions may be embedded in software or firmware. The term "computer readable medium" refers to any tangible medium that participates in providing instructions to processor 504 for execution. Such a medium may take many forms, including but not limited to, non-volatile media and volatile media. Non-volatile media includes, for example, optical or magnetic disks and the like. Volatile media includes dynamic memory, such as system memory 506.

Common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, or any other medium from which a computer can read. Instructions may further be transmitted or received using a transmission medium. The term "transmission medium" may include any tangible or intangible medium that is capable of storing, encoding or carrying instructions for execution by the machine, and includes digital or analog communications signals or other intangible medium to facilitate communication of such instructions. Transmission media includes coaxial cables, copper wire, and fiber optics, including wires that comprise bus 502 for transmitting a computer data signal.

In some examples, execution of the sequences of instructions may be performed by computing platform 500. According to some examples, computing platform 500 can be coupled by communication link 521 (e.g., a wired network, such as LAN, PSTN, or any wireless network) to any other processor to perform the sequence of instructions in coordination with (or asynchronous to) one another. Computing platform 500 may transmit and receive messages, data, and instructions, including program code (e.g., application code) through communication link 521 and communication interface 513. Received program code may be executed by processor 504 as it is received, and/or stored in memory 506 or other non-volatile storage for later execution.

In the example shown, system memory 506 can include various modules that include executable instructions to implement functionalities described herein. In the example shown, system memory 506 includes a crosstalk cancellation filter adjuster 570, which can be configured to provide or consume outputs from one or more functions described herein.

In at least some examples, the structures and/or functions of any of the above-described features can be implemented in software, hardware, firmware, circuitry, or a combination thereof. Note that the structures and constituent elements above, as well as their functionality, may be aggregated with one or more other structures or elements. Alternatively, the elements and their functionality may be subdivided into constituent sub-elements, if any. As software, the above-described techniques may be implemented using various types of programming or formatting languages, frameworks, syntax, applications, protocols, objects, or techniques. As hardware and/or firmware, the above-described techniques may be implemented using various types of programming or integrated circuit design languages, including hardware description languages, such as any register transfer language ("RTL") configured to design field-programmable gate arrays ("FPGAs"), application-specific integrated circuits ("ASICs"), or any other type of integrated circuit. According to some embodiments, the term "module" can refer, for example, to an algorithm or a portion thereof, and/or logic implemented in either hardware circuitry or software, or a combination thereof. These can be varied and are not limited to the examples or descriptions provided.

In some embodiments, an audio device implementing a cross-talk filter adjuster can be in communication (e.g., wired or wirelessly) with a mobile device, such as a mobile phone or computing device, or can be disposed therein. In some cases, a mobile device, or any networked computing device (not shown) in communication with an audio device implementing a cross-talk filter adjuster can provide at least some of the structures and/or functions of any of the features described herein. As depicted in FIG. 1 and subsequent figures, the structures and/or functions of any of the above-described features can be implemented in software, hardware, firmware, circuitry, or any combination thereof. Note that the structures and constituent elements above, as well as their functionality, may be aggregated or combined with one or more other structures or elements. Alternatively, the elements and their functionality may be subdivided into constituent sub-elements, if any. As software, at least some of the above-described techniques may be implemented using various types of programming or formatting languages, frameworks, syntax, applications, protocols, objects, or techniques. For example, at least one of the elements depicted in any of the figure can represent one or more algorithms. Or, at least one of the elements can represent a portion of logic including a portion of hardware configured to provide constituent structures and/or functionalities.

For example, an audio device implementing a cross-talk filter adjuster, or any of their one or more components can be implemented in one or more computing devices (i.e., any mobile computing device, such as a wearable device, an audio device (such as headphones or a headset) or mobile phone, whether worn or carried) that include one or more processors configured to execute one or more algorithms in memory. Thus, at least some of the elements in FIG. 1 (or any subsequent figure) can represent one or more algorithms. Or, at least one of the elements can represent a portion of logic including a portion of hardware configured to provide constituent structures and/or functionalities. These can be varied and are not limited to the examples or descriptions provided.

As hardware and/or firmware, the above-described structures and techniques can be implemented using various types of programming or integrated circuit design languages, including hardware description languages, such as any register transfer language ("RTL") configured to design field-programmable gate arrays ("FPGAs"), application-specific integrated circuits ("ASICs"), multi-chip modules, or any other type of integrated circuit. For example, an audio device implementing a cross-talk filter adjuster, including one or more components, can be implemented in one or more computing devices that include one or more circuits. Thus, at least one of the elements in FIG. 1 (or any subsequent figure) can represent one or more components of hardware. Or, at least one of the elements can represent a portion of logic including a portion of circuit configured to provide constituent structures and/or functionalities.

According to some embodiments, the term "circuit" can refer, for example, to any system including a number of components through which current flows to perform one or more functions, the components including discrete and complex components. Examples of discrete components include transistors, resistors, capacitors, inductors, diodes, and the like, and examples of complex components include memory, processors, analog circuits, digital circuits, and the like, including field-programmable gate arrays ("FPGAs"), application-specific integrated circuits ("ASICs"). Therefore, a circuit can include a system of electronic components and logic components (e.g., logic configured to execute instructions, such that a group of executable instructions of an algorithm, for example, and, thus, is a component of a circuit). According to some embodiments, the term "module" can refer, for example, to an algorithm or a portion thereof, and/or logic implemented in either hardware circuitry or software, or a combination thereof (i.e., a module can be implemented as a circuit). In some embodiments, algorithms and/or the memory in which the algorithms are stored are "components" of a circuit. Thus, the term "circuit" can also refer, for example, to a system of components, including algorithms. These can be varied and are not limited to the examples or descriptions provided.

Although the foregoing examples have been described in some detail for purposes of clarity of understanding, the above-described inventive techniques are not limited to the details provided. There are many alternative ways of implementing the above-described invention techniques. The disclosed examples are illustrative and not restrictive.

What is claimed:

1. A method comprising:

receiving multiple channels of audio;

determining a physical characteristic of a position relative to the origination of the multiple channels of audio;

canceling crosstalk in a spatial region coincident with the position at a first location;

detecting a change in the physical characteristic of one or more devices configured to receive audio signals at the position, the physical characteristic being an orientation of at least one of the one or more devices, the orientation being determined using an optical signal; and adjusting the cancellation of crosstalk responsive to detecting the change in the physical characteristic to establish another spatial region about the position, the position being moved to a second location.

2. The method of claim 1, wherein receiving the multiple channels of audio comprises:

receiving the multiple channels of audio at a dipole speaker.

3. The method of claim 1, wherein detecting the change comprises detecting the change in the position from the first location to the second location.

4. The method of claim 3, further comprising:

calculating an angle and a distance of the position responsive to the change in the position from the first location to the second location.

5. The method of claim 4, wherein adjusting the cancellation of crosstalk comprises:

adjusting operation of a crosstalk cancellation filter based on at least one of the angle and the distance of the position.

6. The method of claim 1, wherein determining the physical characteristic comprises:

detecting an orientation of the position at the first location.

7. The method of claim 6, wherein detecting the change in the physical characteristic comprises:

detecting a change in the orientation of the position; and determining a next orientation.

8. The method of claim 7, further comprising:

calculating an angle, a distance, and the next orientation of the position responsive to the change in the orientation of the position.

9. The method of claim 8, wherein adjusting the cancellation of crosstalk comprises:

adjusting operation of a crosstalk cancellation filter based on at least one of the angle, the distance, and the next orientation of the position.

10. The method of claim 1, further comprising:

monitoring a position and an orientation periodically;

detecting a change in one of the position and the orientation; and readjusting the adjusting the cancellation of crosstalk.

11. An apparatus comprising:

a plurality of transducers configured to project multiple channels of audio;

a memory including executable instructions to implement a crosstalk adjuster; and a processor coupled to the memory, the processor configured to execute the executable instructions to implement the crosstalk adjuster to cause the plurality of transducers to project the multiple channels of audio, the processor further configured to:

execute instructions to determine a physical characteristic of a position relative to the origination of the multiple channels of audio;

execute instructions to cancel crosstalk in a spatial region coincident with the position at a first location;

execute instructions to detect a change in the physical characteristic of one or more devices configured to receive audio signals at the position, the physical characteristic being an orientation of at least one of the one or more devices, the orientation being determined using an optical signal; and execute instructions to adjust the cancellation of crosstalk responsive to detecting the change in the physical characteristic to establish another spatial region at a second location.

12. The apparatus of claim 11, wherein the processor is further configured to:

execute instructions to provide the multiple channels of audio at a dipole speaker.

13. The apparatus of claim 11, wherein the processor is further configured to:

execute instructions to calculate an angle and a distance of the position responsive to the change in the position.

14. The apparatus of claim 13, wherein the processor is further configured to:

execute instruction to adjust operation of a crosstalk cancellation filter based on at least one of the angle and the distance of the position.

15. The apparatus of claim 11, wherein the processor is further configured to:

execute instruction to detect an orientation of the position.

16. The apparatus of claim 15, wherein the processor is further configured to:

execute instructions to detect a change in the orientation of the position; and execute instructions to determine a next orientation.

17. The apparatus of claim 16, wherein the processor is further configured to:

execute instructions to calculate an angle, a distance, and the next orientation of the position responsive to the change in the orientation of the listener; and execute instructions to adjust operation of a crosstalk cancellation filter based on at least one of the angle, the distance, and the next orientation of the position.

18. The apparatus of claim 11, wherein the processor is further configured to:

execute instructions to monitor a position and an orientation periodically;

execute instructions to detect a change in one of the position and the orientation; and execute instructions to readjust the adjusting the cancellation of crosstalk.

* * * * *